US008109317B2

(12) United States Patent
Bostyn

(10) Patent No.: US 8,109,317 B2
(45) Date of Patent: Feb. 7, 2012

(54) DEVICE WITH SHUTTER AND ELEMENT FOR THE REINSERTION OF A SHUTTER INTO A GUIDE SLIDE

(75) Inventor: Frederic Bostyn, Flobecq (BE)

(73) Assignee: Dynaco Europe, Moorsel (BE)

( * ) Notice: Subject to any disclaimer, the term of this patent is extended or adjusted under 35 U.S.C. 154(b) by 68 days.

(21) Appl. No.: 12/663,487

(22) PCT Filed: Jun. 13, 2008

(86) PCT No.: PCT/EP2008/057461

§ 371 (c)(1),
(2), (4) Date: Dec. 7, 2009

(87) PCT Pub. No.: WO2008/155292

PCT Pub. Date: Dec. 24, 2008

(65) Prior Publication Data

US 2010/0181033 A1 Jul. 22, 2010

(30) Foreign Application Priority Data

Jun. 13, 2007 (EP) ..... 07110219

(51) Int. Cl.
*E06B 9/56* (2006.01)

(52) U.S. Cl. ..... 160/273.1; 160/271

(58) Field of Classification Search ..... 160/37, 160/36, 264, 268.1, 271, 273.1, 201, 310, 160/272, 277, 194; 474/144, 154
See application file for complete search history.

(56) References Cited

U.S. PATENT DOCUMENTS

| | | | | |
|---|---|---|---|---|
| 4,884,617 | A | 12/1989 | Coenraets | |
| 7,036,549 | B2 * | 5/2006 | Coenraets | 160/271 |
| 7,748,431 | B2 * | 7/2010 | Jansen et al. | 160/268.1 |
| 2005/0211397 | A1 * | 9/2005 | Coenraets | 160/271 |
| 2005/0211398 | A1 * | 9/2005 | Coenraets | 160/271 |
| 2006/0248819 | A1 * | 11/2006 | Coenraets | 52/202 |
| 2007/0277941 | A1 * | 12/2007 | Jansen et al. | 160/271 |
| 2007/0277942 | A1 * | 12/2007 | Dondlinger et al. | 160/273.1 |
| 2007/0277943 | A1 * | 12/2007 | Boerger et al. | 160/273.1 |
| 2008/0035282 | A1 * | 2/2008 | Coenraets | 160/272 |
| 2008/0110580 | A1 * | 5/2008 | Hoerner et al. | 160/113 |
| 2010/0181033 | A1 * | 7/2010 | Bostyn | 160/368.1 |
| 2010/0263286 | A1 * | 10/2010 | Jansen et al. | 49/358 |
| 2011/0067307 | A1 * | 3/2011 | Dondlinger et al. | 49/26 |

* cited by examiner

FOREIGN PATENT DOCUMENTS

| | | |
|---|---|---|
| EP | 0272733 | 6/1988 |
| WO | WO 03/048498 | 6/2003 |
| WO | WO 03/078783 | 9/2003 |

OTHER PUBLICATIONS

Search Report for Application No. PCT/EP2008/057461, 4 pages.

*Primary Examiner* — Blair M. Johnson
(74) *Attorney, Agent, or Firm* — Barnes & Thornburg LLP

(57) ABSTRACT

Device with a shutter and element for the reinsertion of a shutter into a guide slide. Device with a shutter for the closing-off of a bay (1), comprising a slide (7, 8); a deformable shutter (3) comprising a lateral flange (10, 11, 27) which is mounted slidingly in the slide; and a means for reinserting the flange into the slide, after it has been pulled out of the slide, this means comprising at least one pair of rollers (17) which are placed on either side of the shutter and which, while the shutter is moved opposite the bay in order to uncover the latter, roll on the flange which has come out of the slide and push it back into the latter.

13 Claims, 12 Drawing Sheets

1
2
3
4
5
6
7
9
14
II
IV

DEVICE WITH SHUTTER AND ELEMENT FOR THE REINSERTION OF A SHUTTER INTO A GUIDE SLIDE

CROSS-REFERENCE TO RELATED APPLICATION

This application is a National Stage filing of PCT International Application Serial No. PCT/EP2008/057461, filed Jun. 13, 2008, which claims the benefit of European Application Serial No. EP 07110219.8, filed Jun. 13, 2007, the disclosures each of which are expressly incorporated herein by reference.

FIELD OF THE INVENTION

The present invention relates to flexible shutters for closing off openings.

The invention relates more specifically to a shutter device for closing of an opening, comprising:

at least one slideway;

a deformable shutter that can be moved across the opening, in one direction to cover said opening or in the opposite direction to uncover it, said shutter comprising at least one lateral bead which is slideably mounted in the slideway and which can be extracted therefrom under the action of a defined pulling force directed transversely to the slideway; and a means for reinserting into the slideway the bead that has been extracted therefrom, said means comprising a guide member which is positioned facing the slideway and which is designed so that, while the shutter is being moved in the aforementioned opposite direction, it deflects toward the slideway the bead that has been extracted from this slideway.

PRIOR ART

Deformable shutters are commonly used to shut off openings, particularly to cut off warehouses or industrial halls. These shutters are often made up of large flexible tarpaulins the lateral edges of which comprise beads which slide in slideways situated on each side of the opening that is to be closed. The fixing of the lateral beads of the shutter in the slideways is retractable so that these beads can come out of the slideways if subjected to a pulling force in excess of a defined critical value, transversely to the slideway. The purpose of this is to prevent any damage to the shutter in the event of an accidental impact, something which may, for example, occur when a vehicle accidentally runs into the shutter in a closed or insufficiently-open position. This type of shutter involves reinserting into the slideways the lateral beads that may have been accidentally pulled out, in order to return the shutter to service.

Document EP-A 0 272 733 describes a shutter device of the abovementioned type, in which a means is provided so that reinsertion of the lateral beads of the shutter into the slideways occurs automatically. This means consists in making a longitudinal aperture in the top of the slideways, such that as the shutter is raised, the lateral beads thereof, which may have come out of the slideways, return into these slideways when they arrive at the aperture.

Document WO 03/048498 improves on the reinsertion means of document EP-A 0 272 733. In the shutter device of document WO 03/048498, the means of reinserting the lateral beads of the shutter into the slideways comprises, in addition to the aforementioned aperture, a pair of guide blocks which are positioned on each side of the shutter, facing the opening.

The blocks are positioned on each side of the shutter and are separated from one another by a distance which is somewhere between the thickness of the shutter and the thickness of the beads. The blocks are positioned facing the aperture of the slideway such that during the upward movement of the shutter, the bead (which has come out of its slideway) slides against the two guide blocks which guide it, thus pushing it back into the aperture of the slideway.

In this known shutter device, the sliding of the bead of the shutter over the two blocks gives rise to a friction force which acts as a loading on the shutter and impedes its upward movement.

In the devices of documents EP-A 0 272 733 and WO 03/048498 which have just been described, it is necessary to make an aperture in the slideway, the width of which is wide enough that it allows the bead to be reinserted to enter.

SUMMARY OF THE INVENTION

The invention aims to provide an improved shutter device which avoids the disadvantages associated with the rubbing of the shutter against the guide blocks as it is reinserted into the slideways.

To do this, according to the invention, the guide member comprises at least one pair of rollers which are positioned respectively on each side of the shutter so that as the shutter is moved in the aforementioned opposite direction, they roll along the bead which has been extracted from the slideway, pushing it into the slideway.

In this text, the term "opening" means an aperture made in a wall or a partition of a building, or through the ground. The opening may be a vertical opening (for example a door or a window made through a vertical wall of a building), a horizontal opening (for example an aperture made through the ground or through a horizontal roof structure of a building in order to provide access to a chamber or to a cavity), or may alternatively be an opening directed obliquely (as may be the case, for example, of an aperture made through an inclined roof section). The invention applies particularly well to vertical openings.

The shape of the opening is non-critical. In practice, the opening is generally square or rectangular. The dimensions of the opening are not critical either. The invention applies especially to the vertical openings the dimensions of which permit the passage of a land vehicle (for example a motor car, a truck, a semitrailer or a trailer entering a goods warehouse, an industrial workshop or an exhibition hall), an air vehicle (for example an airplane in a ground maintenance shop) or a river vessel (for example a barge entering an unloading warehouse) [this list is non-exhaustive and given by way of example]. The invention also applies to horizontal openings made through the floor and delimiting, for example, a pool, a lake or a basin for storing and/or treating industrial materials (this list is non-exhaustive and given by way of example).

The term "shutter" denotes, in the broadest sense, a removable partition which is at least partially flexible or supple. The shutter may for example comprise a collection of articulated strips, a tarpaulin, a gauze or a grating (this list is non-exhaustive and given by way of example). It may be completely or partially opaque, transparent or translucent. It may be made of metal or of a (co)polymer obtained by chemical synthesis, for example from polyvinyl chloride, possibly reinforced with an organic material (for example glass fiber). Flexible tarpaulins are preferred.

In the device according to the invention, the shutter is designed, in a way known per se, to cover the opening or to uncover it at will. To this end, the shutter may be made to move in opposite directions across the opening, namely in one direction to cover the opening and in the reverse direction to uncover it.

In the remainder of this text, the expression "opposite direction" denotes the direction travel of the shutter in which the shutter gradually uncovers the opening.

The slideway is used to guide the shutter during its movements in the aforementioned two opposite directions. It may be substantially straight and is positioned along the opening. The shutter is guided by at least one lateral bead of the shutter, which is slideably mounted in the slideway. In cross section, the shape of the bead needs to be matched to that of the slideway, so that it is retained therein and can slide therein during the aforementioned movements of the shutter past the opening. Notwithstanding this general condition, the shape of the bead is not critical to the definition of the invention. The bead may, for example, have a circular or polygonal, for example square, rectangular or hexagonal, cross section. A circular cross section is preferred. The bead may form an integral part of the shutter. As an alternative, it may be attached to a border of the shutter and fixed thereto by any appropriate means, for example by bonding, welding or riveting. The bead may be continuous or toothed, and extend over the entire length of the lateral edge of the shutter. As an alternative, the shutter may comprise a row of several beads spaced along the lateral border of the shutter. In the remainder of this text and unless stated otherwise, the term "bead" will denote, without distinction, a continuous or toothed lateral bead, or a lateral row of several beads.

The slideway generally comprises a section piece the cross section of which is matched to that of the bead and which is pierced with a longitudinal slot along which the shutter can pass. It may be made of any material suited to its technical function, for example of metal or of (co)polymer obtained by chemical synthesis, for example of high density polyethylene, possibly reinforced with an organic material (for example glass fibers).

The position of the slideway near the opening will depend on various parameters, particularly the orientation of the opening (while the orientation is horizontal, oblique or vertical) and the direction in which the shutter moves to cover or uncover the opening. In the case of a horizontal opening, the slideway is usually horizontal. In the case of an oblique opening, the slideway is usually oblique. In the case of a vertical opening, the slideway may be vertical or horizontal depending on the chosen direction in which the shutter is moved. The slideway is vertical when the shutter is moved vertically to open or close the opening. The slideway is horizontal when the shutter is moved horizontally to open or close the opening.

The position of the lateral bead on the shutter is governed by the position of the slideway with which the bead collaborates in order to guide the shutter.

The bead and the slideway are also designed and shaped in such a way as to allow the bead to be pulled out of the slideway when subjected to a defined pulling force (stronger than a reference value), directed in the plane of the shutter and transversely to the slideway.

In this definition of the invention, the expression "plane of the shutter" is intended to denote an imaginary geometric plane, defined by the shutter when it is covering the opening.

The pulling of the bead out of its slideway under the action of the aforementioned force must occur without damage either to the shutter, the bead or the slideway. The profile and dimensions of the slideway and of the bead and their ability to withstand deformation must therefore be tailored such that the pulling force needed to pull the bead out of the slideway is lower than a critical value liable to tear the shutter or damage the slideway or the bead. The pulling force has, however, to be substantial and enough to prevent the bead from coming out of the slideway accidentally during normal operation of the shutter.

Additional information regarding the shutter, the slideway and the bead is accessible in documents EP-A 0 272 733 and WO 03/048498 (both in the name of Dynaco International).

The shutter device according to the invention is also equipped with a means designed so that, when the bead has been pulled out of its slideway, it is reinserted automatically thereinto while the shutter is being moved in the direction for uncovering the opening (the "opposite direction" defined above). According to the invention, this means comprises at least one pair of rollers which are positioned respectively on each side of the shutter so that as the shutter is moved in the aforementioned opposite direction (in which it uncovers the opening), these rollers roll along the bead which has been extracted from the slideway and pushes it into the slideway.

In the shutter device according to the invention, the position of the rollers facing the slideway is of great importance. It has to be chosen such that as the shutter moves in the aforementioned opposite direction, the rollers turn on the bead (which has been pulled out of the slideway) and forces it through the aforementioned longitudinal slot in the slideway to enter this slideway. To reinforce said action of the rollers it is recommended, in an advantageous embodiment of the invention, that the surface of the rollers be ribbed. That gives the rollers a better grip on the bead. In the device according to the invention, the separation between the two rollers has to be greater than the thickness of the shutter (in order not to impede its movement past the opening) and less than the thickness of the bead (so that they press thereon). A substantial separation is normally left between the rollers and the slideway. Ideally, this separation needs to be small enough that the force exerted by the rollers on the bead is enough to reinsert the latter into the slideway. However, it is necessary to avoid having too small a separation as this would subject the rollers, the bead and the slideway to excessive mechanical force. The optimum separation has therefore to be determined by the person skilled in the art to suit each particular circumstance.

According to one particular embodiment of the shutter device according to the invention, the separation between the rollers is adjustable. This embodiment is suited to the use of shutters of differing thicknesses.

In another particular embodiment of the invention, an aperture is made in the slideway facing the rollers. In this embodiment of the invention, the purpose of the aperture is to reduce the force applied to the bead while it is being reinserted into the slideway. In this embodiment of the invention, the rollers may be partially engaged in the aperture of the slideway, so as always to roll along the bead, even when this bead is normally in place in its slideway. However, it is preferable to maintain a substantial separation between the rollers and the bead, for the reasons set out above.

In the shutter device according to the invention, the rollers may have any shape compatible with their technical function.

In the shutter device according to the invention, the rollers lie opposite one to another with respect to the mid-plane of the shutter (the mid-plane of the shutter was defined hereinabove).

Preferably, the rollers are positioned symmetrically on each side of the mid-plane of the shutter.

In the shutter device according to the invention, the rollers comprise axes of rotation that are positioned opposite one to another with respect to the mid-plane of the shutter.

In one preferred embodiment of the invention, the fixed axes of rotation of the rollers are situated symmetrically on each side of the mid-plane of the shutter.

In this embodiment of the invention, the two axes of rotation of the two rollers are preferably situated substantially in the same geometric plane and this plane is preferably substantially perpendicular to the mid-plane of the shutter.

In another preferred embodiment of the invention, the two rollers converge towards the slideway. All other factors remaining the same, the optimum angle of convergence for the two rollers is the result of a compromise between seeking to obtain a maximum value for the force exerted by the rollers to force the bead back into the slideway from which it has been pulled out, and seeking to achieve minimal wear of the rollers, of the bead and of the slideway. The optimum angle of convergence has therefore to be determined by the person skilled in the art for each particular case according to circumstances.

The rollers are advantageously mounted to rotate on ball bearings or other similar rolling-contact bearings.

In the shutter device according to the invention, the rollers have to be mechanically strong enough that they can withstand the mechanical forces exerted on them by the shutter. Notwithstanding this condition, the dimensions of the rollers and the material of which they are made are not critical to the definition of the invention. The rollers may, for example, be made of metal (for example of steel) or of a (co)polymer obtained by chemical synthesis (for example of polyester, polyamide or elastomer).

In one particular embodiment of the invention, the slideways are provided with a reinforcing means in their zone adjoining the rollers. In this embodiment of the invention, the zone adjoining the rollers is a zone normally situated in close proximity to the rollers, downstream thereof with respect to the movement of the shutter in the opposite direction defined above. This reinforcing means may, advantageously, comprise a U-section into which the slideway is set. The U-section may be made of metal (for example of steel) or of a (co) polymer with high mechanical strength, such as a polyamide for example.

In an advantageous alternative form of the embodiment that has just been described, the rollers are fixed to a frame comprising the U-section. This alternative form of the invention allows the rollers to be moved at will along the slideway. It also makes it easier to replace the rollers, for example in the event that these become worn or damaged. To this end, in this alternative form of the invention, it is advantageous for the frame and the slideway to be fixed to a fixed support, for example a metal framework positioned along the opening and cemented into an appropriate structure, for example masonry.

In a particular embodiment of this alternative form of the invention, the frame comprises an axial channel and at least one part of the U-section consists of this axial channel. In this embodiment of the invention, the frame is advantageously obtained by molding.

In the device according to the invention, the shutter may comprise a single slideway and a single bead collaborating with said slideway to guide the shutter.

In one particular embodiment of the invention, the shutter comprises a second lateral bead which is slideably mounted in a second slideway from which it can be extracted under the action of a defined pulling force directed transversely to the slideway, and a second pair of rollers which are arranged respectively on each side of the shutter such that when the shutter is being moved in the aforementioned opposite direction, the rollers of said second pair roll along said second bead which has been extracted from said second slideway, pushing it into this slideway.

In the shutter device according to the invention, the use of rollers to automatically reinsert the or each bead of the shutter into its slideway has the advantage of considerably reducing the mechanical loadings applied to the shutter and to the or each bead. As a result, the invention substantially lengthens the life of the shutters.

The invention also relates to an element for reinserting a lateral bead of a shutter into a slideway from which said bead has been extracted, this reinsertion element comprising a frame designed to be mounted on a support of the slideway, the frame comprising, on the one hand, a U-section axial channel into which the slideway can be set, and, on the other hand, at least one pair of rollers which are situated beyond one end of the aforementioned channel and which are positioned in such a way that when the slideway is set into the channel of the frame, the rollers roll along the bead that has been extracted from the channel section and forces it back into the latter when the shutter is moved in a defined direction.

In the reinsertion element according to the invention, the terms "shutter", "slideway", "bead", "guide member" and "roller" have been defined above, as have their respective functions.

In a preferred embodiment of the reinsertion element according to the invention, the rollers have fixed axes of rotation and the two axes of rotation of the two rollers are located symmetrically on each side of the mid-plane of the U-shaped channel of the frame. These two axes are preferably situated in the same plane which is substantially perpendicular to said mid-plane of the channel and are advantageously directed obliquely so that the rollers converge toward the bottom of the channel.

The reinsertion element according to the invention can easily be fitted to shutter devices according to the invention. It can be fitted to existing shutters comprising a lateral bead sliding in a guide slideway.

When the reinsertion element according to the invention is being mounted on an existing shutter, the frame of the reinsertion element needs to be directed in such a way that the rollers are situated downstream of the aforementioned channel, with respect to the opposite direction defined above.

The invention has numerous applications, particularly for closing off large vertical openings that provide access to hangars or warehouses, or for covering basins filled with water (such as industrial water treatment basis or pools) or alternatively for covering horizontal openings providing access to silos or other spaces in which goods or industrial products are stored.

BRIEF DESCRIPTION OF THE FIGURES

Specifics and details of the invention will become apparent during the following description of the attached figures which shows one particular embodiment of the invention.

Figures 1, 2:
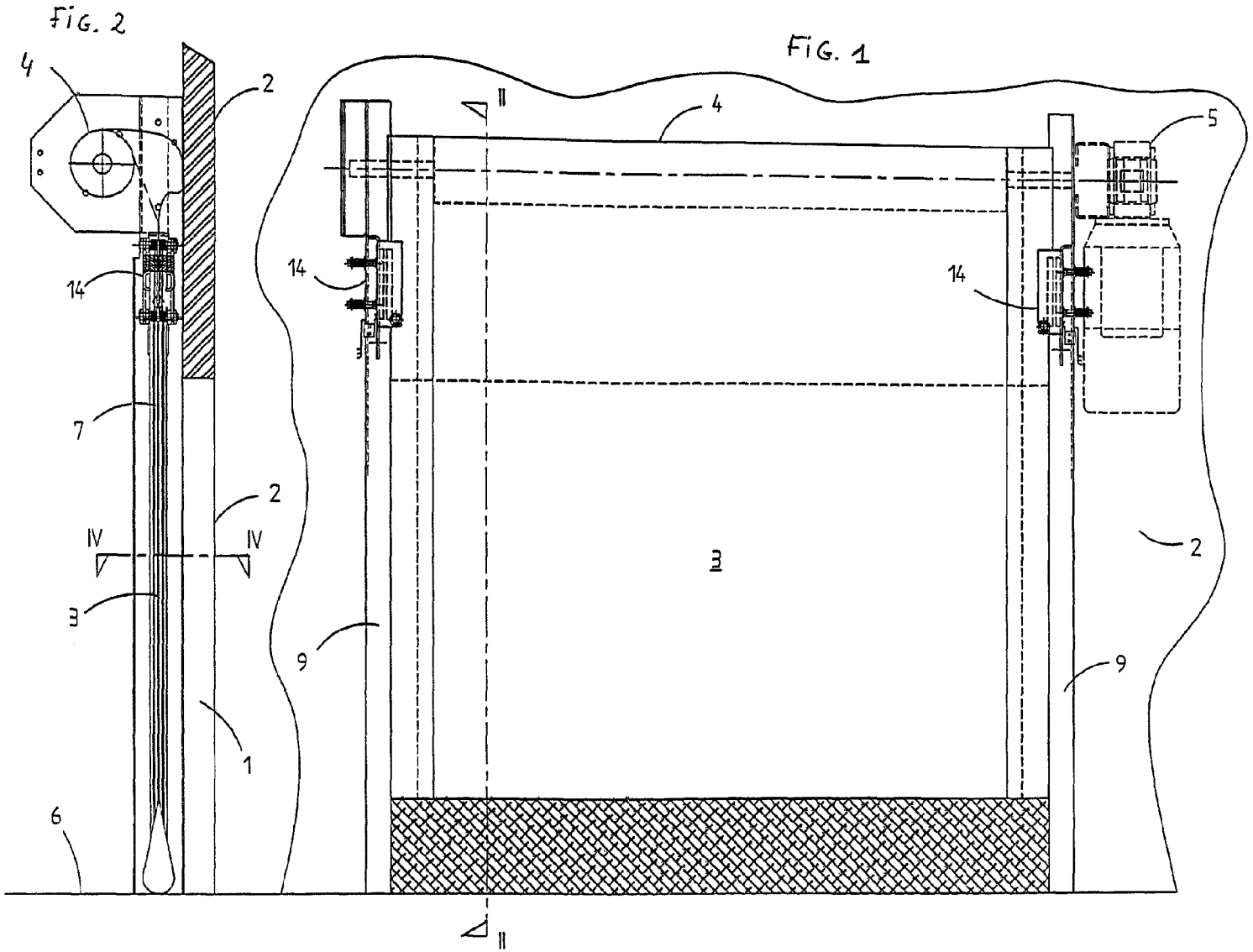
FIG. 1 is a schematic front view of a shutter device according to the invention, in the closed position.
FIG. 2 shows the shutter device of FIG. 1, in vertical section according to the plane II-II of FIG. 1.

The figures are not to scale.

In general, the same reference numerals denote elements that are the same or elements that are similar.

DETAILED DESCRIPTION OF PARTICULAR EMBODIMENTS

Figure 3:
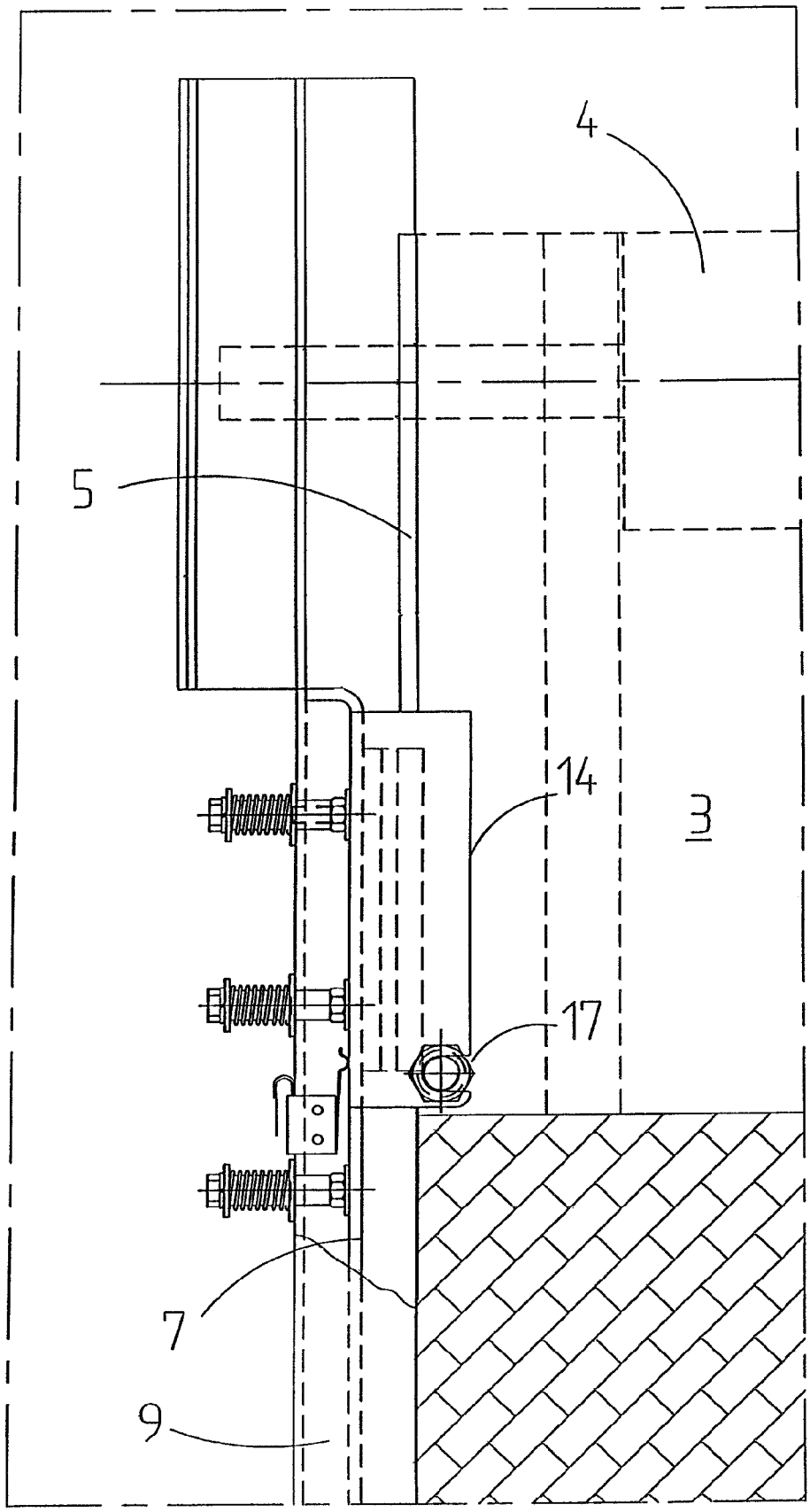
FIG. 3 is a view on a large scale, of a detail of FIG. 1, showing the reinsertion element according to the invention.

FIGS. 1 to 3 show a vertical opening 1, pierced through a vertical partition wall 2 of a building, for example an industrial or commercial warehouse. The dimensions of the opening 1 allow the passage of a truck (not represented).

The partition 2 is equipped with a shutter device according to the invention. This shutter device comprises a shutter 3, formed of a flexible tarpaulin, for example made of glass fiber reinforced polyvinyl chloride. The shutter 3 is fixed, at its upper part, to a horizontal drum 4 situated above the opening 1. The drum 4 is coupled to an electric motor 5, actuation of which enables the shutter 3 to be lowered in order to cover the opening 1 and close the building or raised to uncover the opening 1 and allow a truck through.

Figure 4:
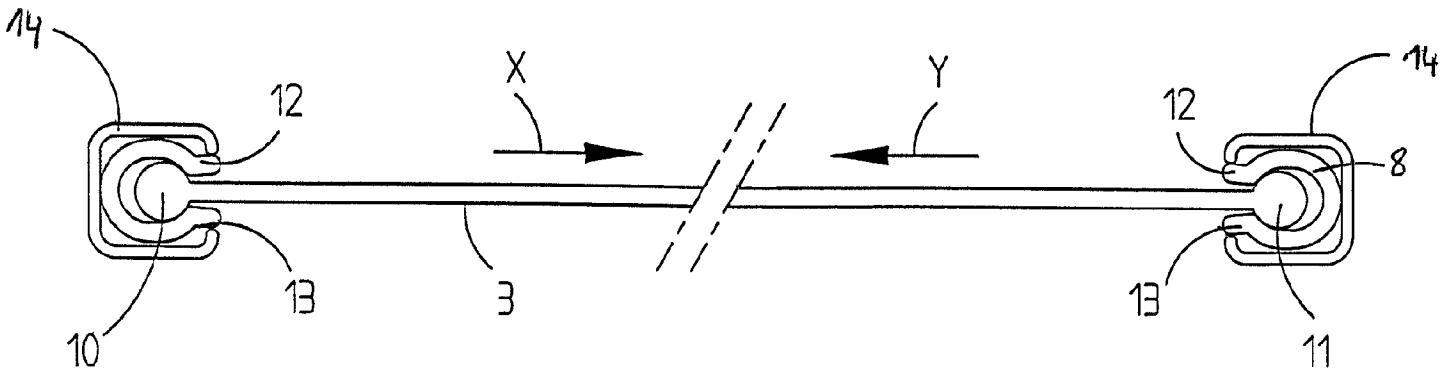
FIG. 4 shows the shutter of FIGS. 1 to 3, in horizontal section according to the plane IV-IV of FIG. 2.

A pair of vertical slideways 7 and 8 are arranged respectively along the vertical edges of the opening 1. The slideways 7, 8 are fixed to a metal framework 9 which is cemented into the floor 6. The slideways 7, 8 serve to guide the shutter 3 during its raising and lowering movements. To this end, the shutter 3 is equipped with two lateral beads 10 and 11, which are engaged in the slideways 7 and 8. In FIG. 4, the beads 10 and 11 have a circular profile and their thickness is greater than that of the shutter 3. The slideways 7 and 8 are section pieces of circular cross section, extended by two flanges 12 and 13 which between them delimit a vertical longitudinal slot 16. The width of the slot 16 is somewhere between the thickness of the tarpaulin of the shutter 3 and the thickness of the beads 10 and 11. Thus, the beads 10 and 11 slide in the slideways 7 and 8 while the shutter 3 is being lowered or raised. Each of the slideways 7 and 8 is set into a frame 14 which will be explained later on.

The slideways 7 and 8, particularly their flanges 12 and 13, are designed so that the beads 10 and 11 can come out of the slideways through the slot 16 once pulling forces X and Y (FIG. 4) are exerted on the beads in the plane of the shutter and transversely to the slideways. This situation may, for example, arise when, with the shutter down or insufficiently raised, it is struck hard by a vehicle entering or leaving the warehouse. It is beneficial for the pulling force X, Y needed to pull the beads 10, 11 out of their respective slideways 7 and 8 to be as large as possible, so as to prevent the beads 10 and 11 from arbitrarily leaving their slideways 7 and 8 while the shutter 3 is being operated. This pulling force does, however, need to remain below a critical value, so as to prevent the tarpaulin of the shutter 3 from being torn.

Figure 5:
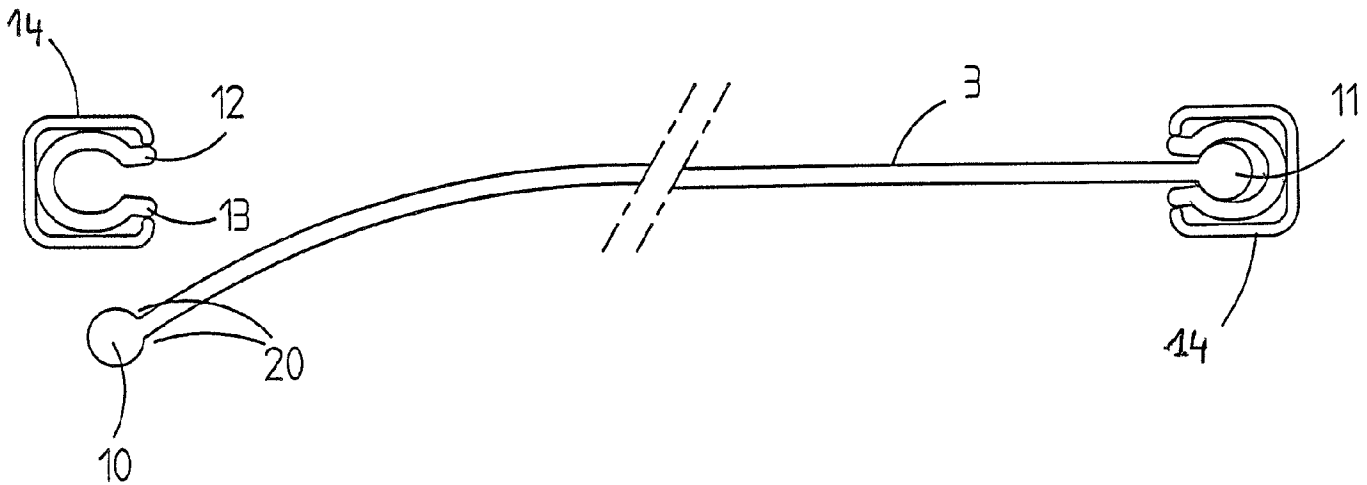
FIG. 5 is a view similar to that of FIG. 4, in which one bead of the shutter has been pulled out of its slideway.
Figure 6:
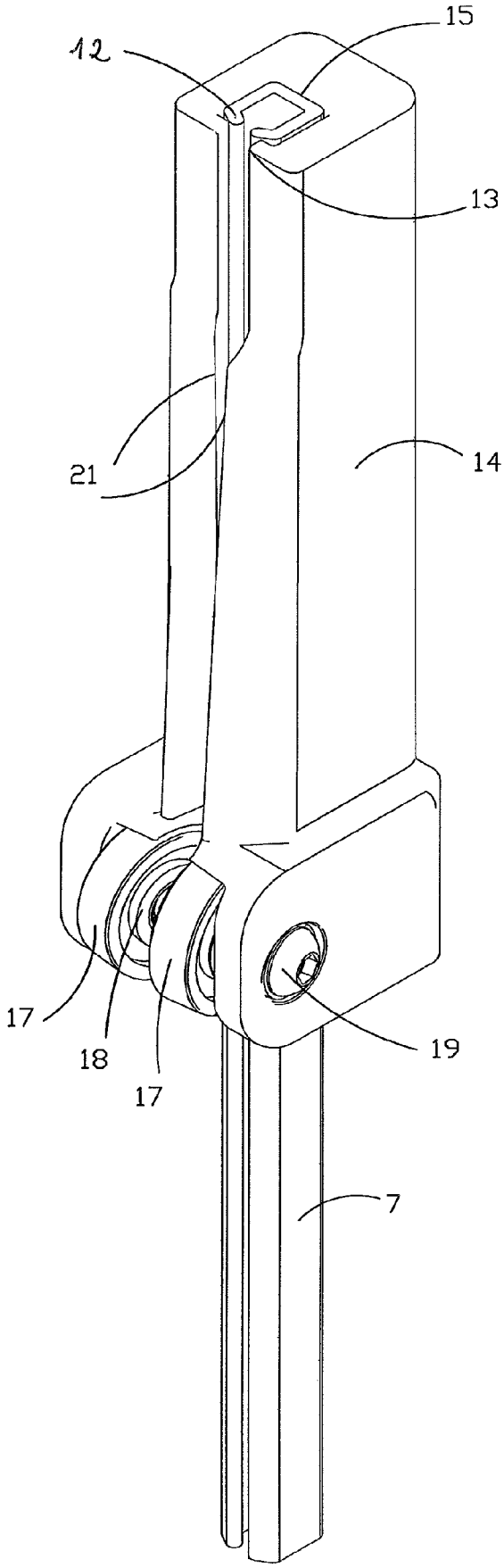
FIG. 6 shows, in perspective, the reinsertion element with which the device of FIGS. 1 to 3 is equipped.
Figure 7:
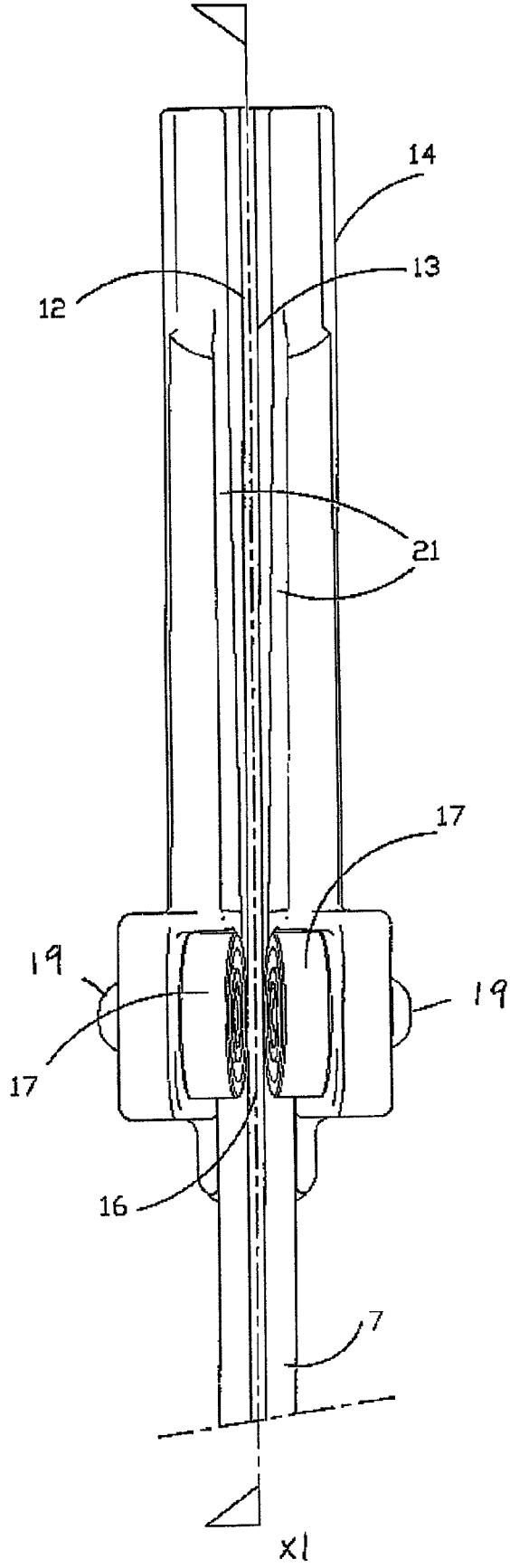
FIG. 7 is a front view of the reinsertion element of FIG. 6.
Figure 8:
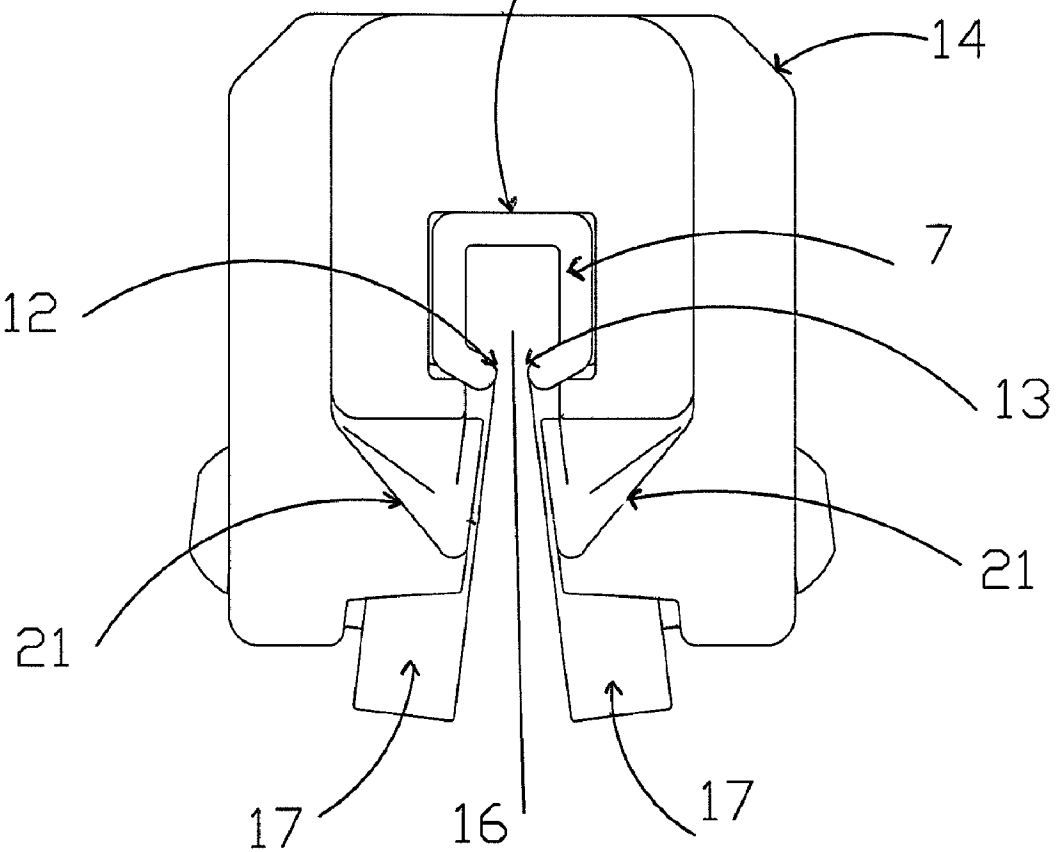
FIG. 8 is a plan view of the reinsertion element of FIGS. 6 and 7.

FIG. 5 shows the shutter 3 the bead 10 of which has been pulled out of its slideway 7.

The slideways 7 and 8 are, for example, made of high density polyethylene.

The shutter device shown in the figures is equipped with an element according to the invention, for reinserting the bead 10 (or the bead 11) into its slideway 7 (or 8) after it has been pulled out thereof. This device, better represented in FIGS. 6 to 10, comprises a frame 14 which is fixed to the framework 9 (FIGS. 1 and 3) in the upper part of the slideway. The frame 14 is pierced with a straight axial channel 15, the U-shaped profile of which allows the slideway 7, 8 to be set into it. The frame 14 is advantageously a body molded from high strength plastic, for example a polyamide.

In FIGS. 6 to 10, the slideway 7 is set into the channel 15 of the frame 14. The frame 14 has the function of improving the rigidity of the slideway 7 set into it. To this end, the frame 14 has two longitudinal flanges 21 which bear respectively on the flanges 12 and 13 of the slideway 7. The frame 14 and its flanges 21 have to be rigid enough that they prevent any deformation of the slideway 7 in the frame 14 while the bead is being reinserted into the slideway in the way that will be explained later on.

A sufficient separation needs to be left between the two flanges 21 to allow the shutter 3 to pass.

In its lower part, the frame 14 is equipped with a pair of rollers 17, mounted on ball bearings 18 set on fixed shafts 19. The shafts 19 are directed in such a way that the two rollers 17 are situated symmetrically on each side of the axial plane of the slideway 7 and in close proximity to the slot 16 of the slideway 7. Furthermore, the rollers 17 are positioned near the lower end of the frame 14. This frame is thus situated downstream of the rollers 17, with respect to the direction of raising the shutter 3.

Figure 9:
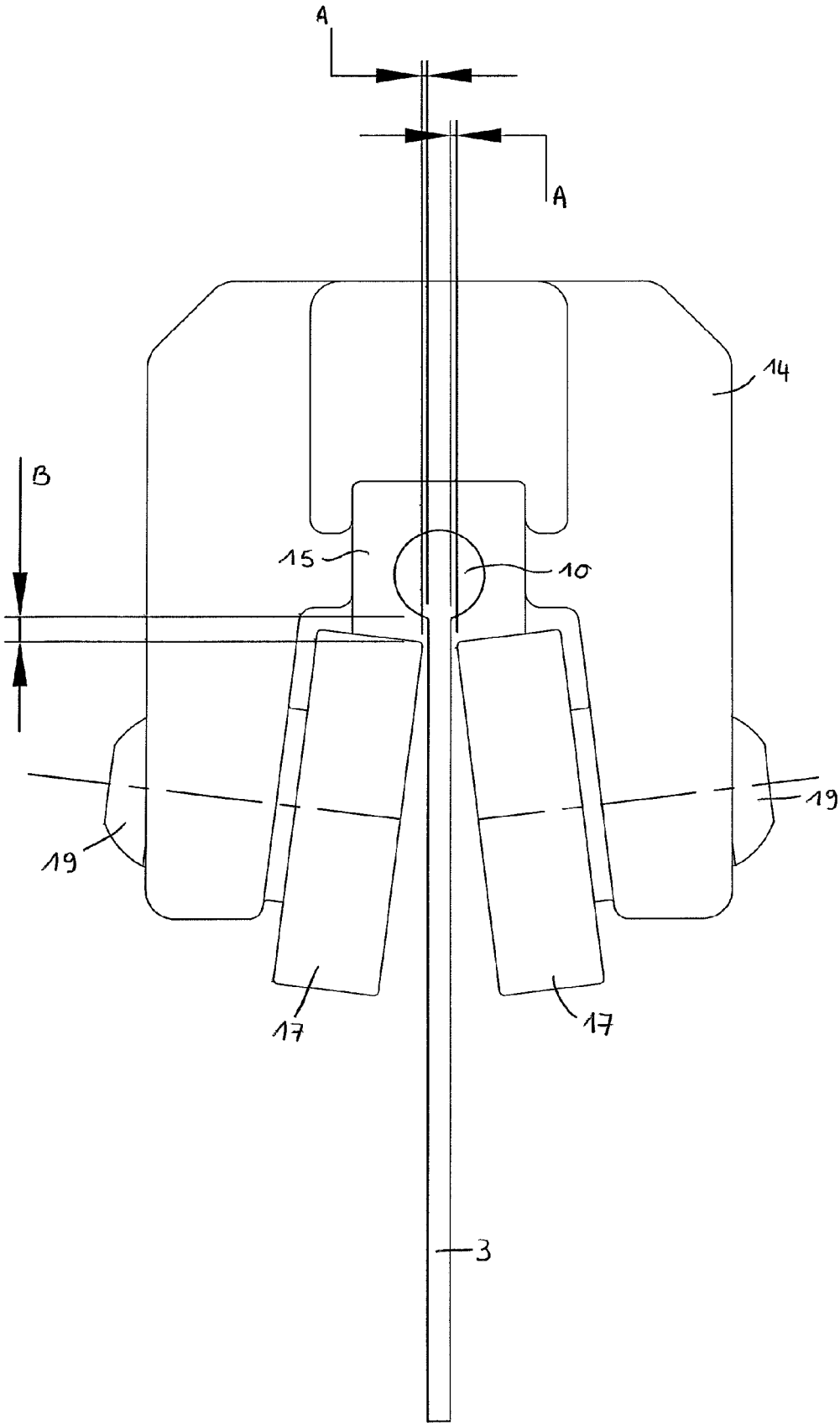
FIG. 9 shows, on a large scale, a detail of FIG. 8.

FIG. 9 shows, in detail, the position of the rollers 17 on the frame 14 in relation to the slideway 7 set into this frame and with a bead 10 sliding in the slideway 7. The two rollers 17 face the slot 16 of the slideway 7 and converge toward the slot 16. The separation between the two rollers 17 is chosen so as to maintain, between each roller 17 and the shutter 3, a distance A that is large enough not to impede normal operation of the shutter, while at the same time preventing the bead 10 of the shutter from being able to slip between the rollers 17. Furthermore, the rollers 17 are positioned in such a way as to maintain a substantial separation B between them and the bead 10, when this bead is sliding in its slideway 7 in the normal way.

Figure 10:
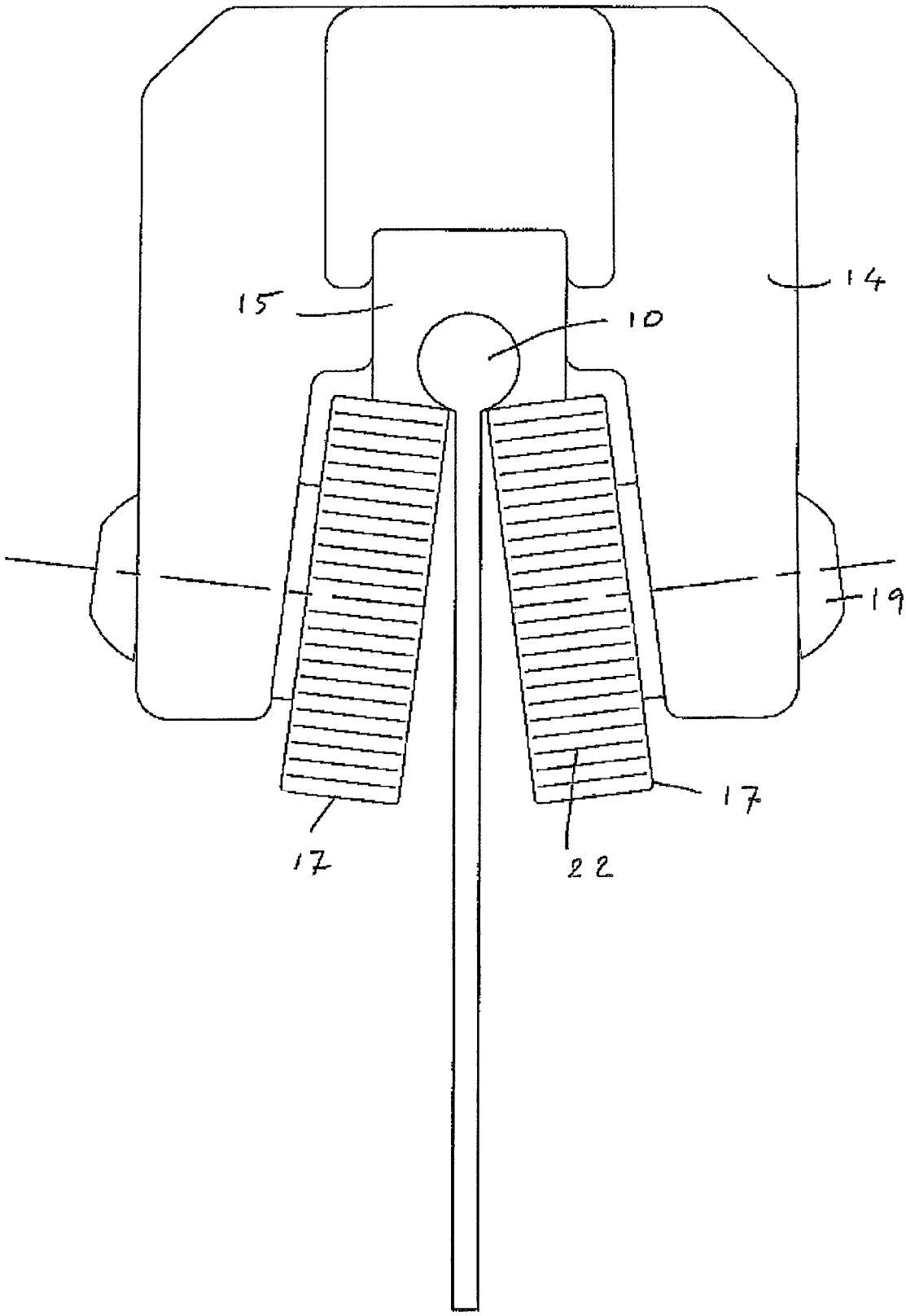
FIG. 10 shows another detail of FIG. 8, on a large scale.

FIG. 10 shows one advantageous embodiment of the invention, in which the rollers 17 are ribbed at their periphery. The ribs 22 of the rollers 17 improve the grip of the rollers on the bead while the latter is being reinserted into its slideway in the way that will be described later on.

The way in which the reinsertion device according to the invention works will now be explained with reference to FIGS. 11 to 14 in particular.

Figure 11:
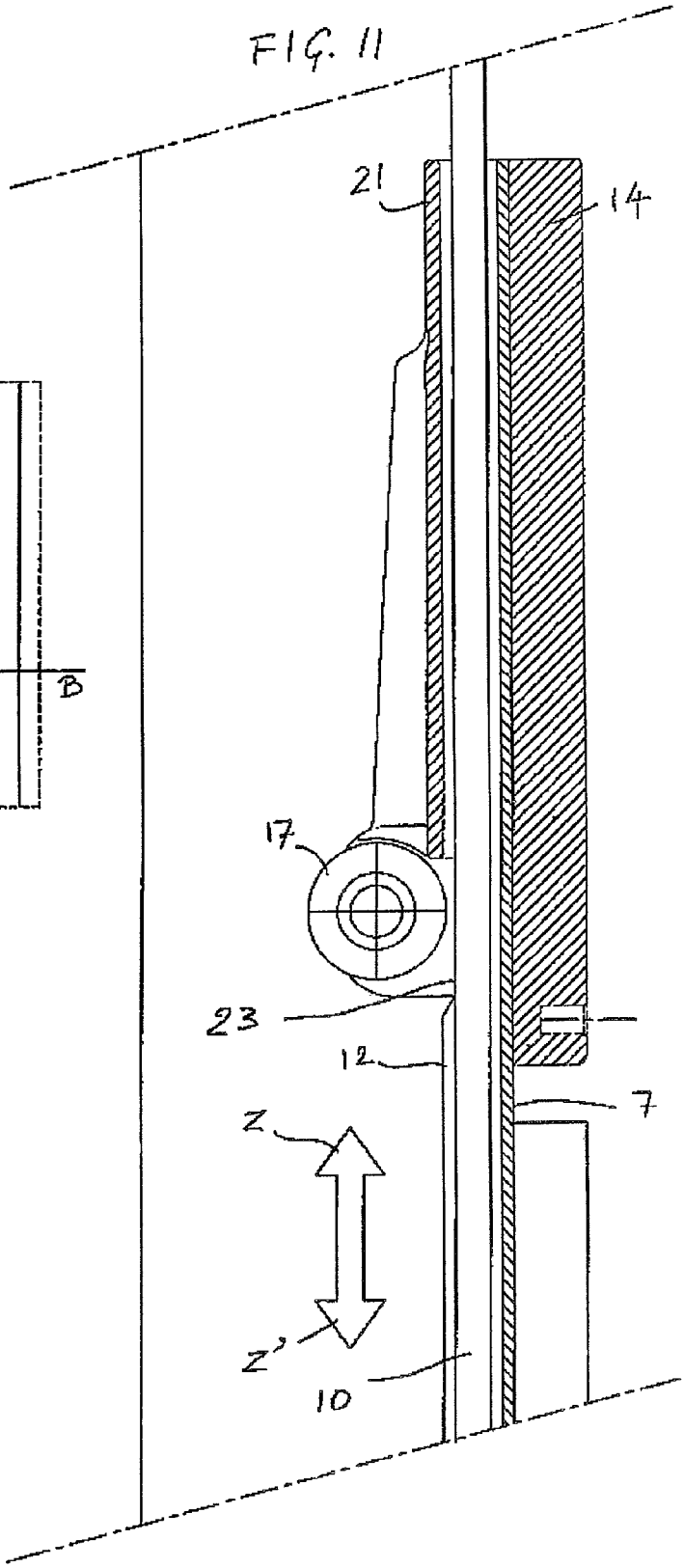
FIG. 11 shows, in vertical axial section according to the plane XI-XI of FIG. 7, the reinsertion element of FIGS. 6 to 10, combined with a slideway of a shutter.

In FIG. 11, it may be seen that the bead 10 of the shutter 3 is engaged in its slideway 7 in the normal way. The bead 10 therefore slides normally in its slideway 7, to guide the shutter as the latter is subjected to upward or downward movements in the directions of the arrows Z-Z'.

Figure 12:
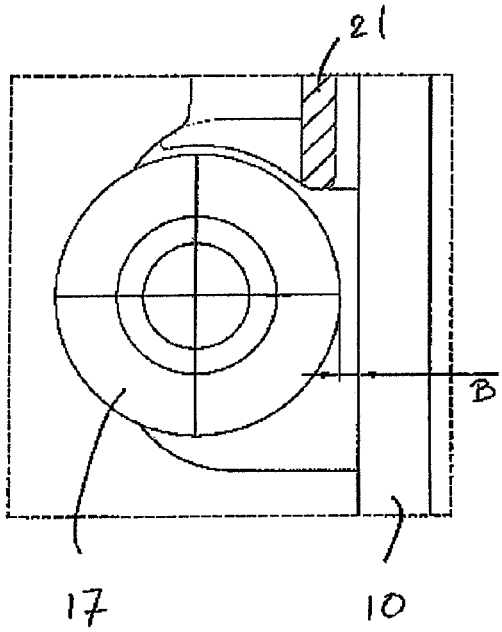
FIG. 12 shows, on a large scale, a detail of FIG. 11.

An aperture 23 has been cut in the slideway 7 facing the rollers 17. The aperture 23 has been cut in the flanges 12 and 13 of the slideway 7. FIG. 12 shows a substantial separation B between the rollers 17 and the bead 10. This bead is therefore not loaded by the roller 17 while the shutter 3 is operating normally.

Figure 13:
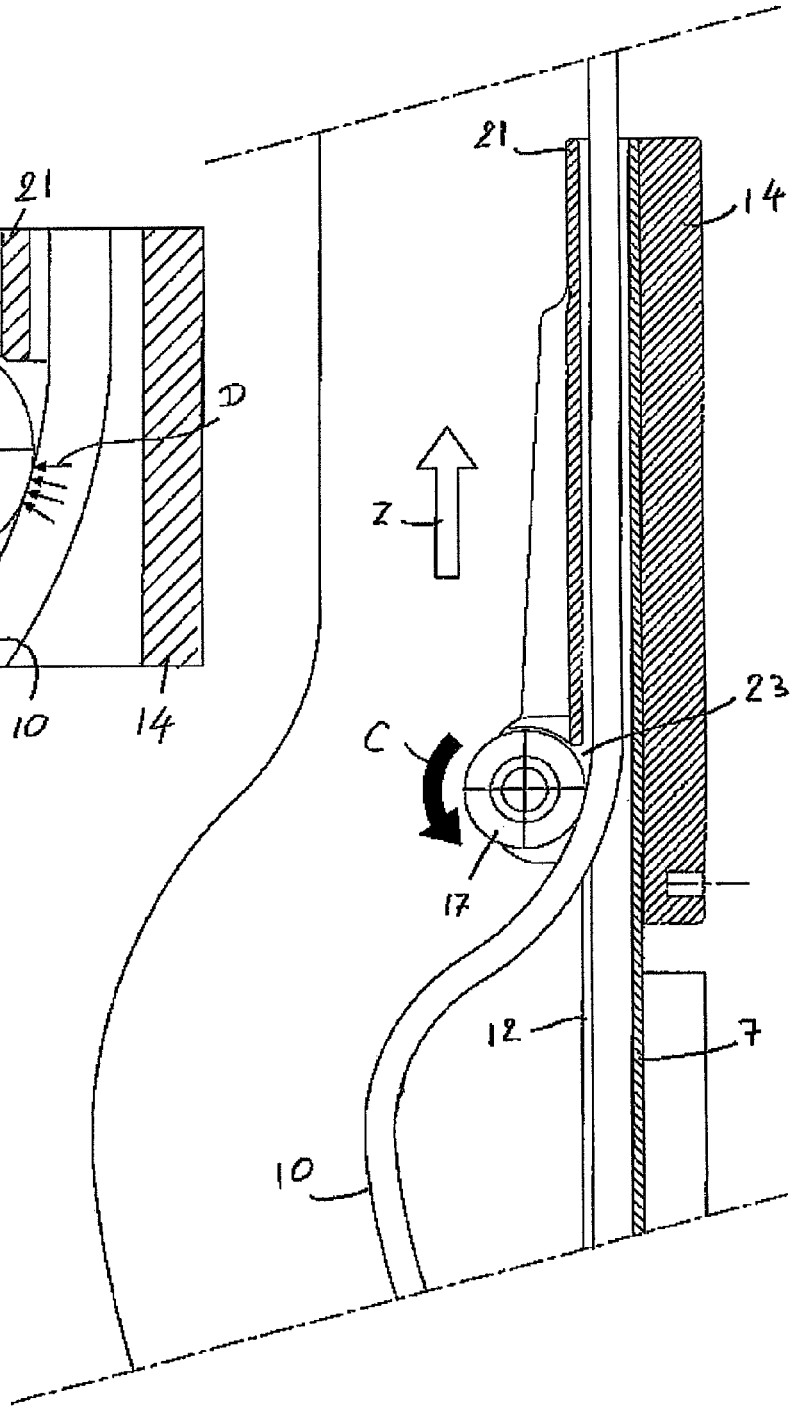
FIG. 13 is a view similar to that of FIG. 11, schematically showing how the reinsertion element of FIGS. 6 to 10 works.
Figure 14:
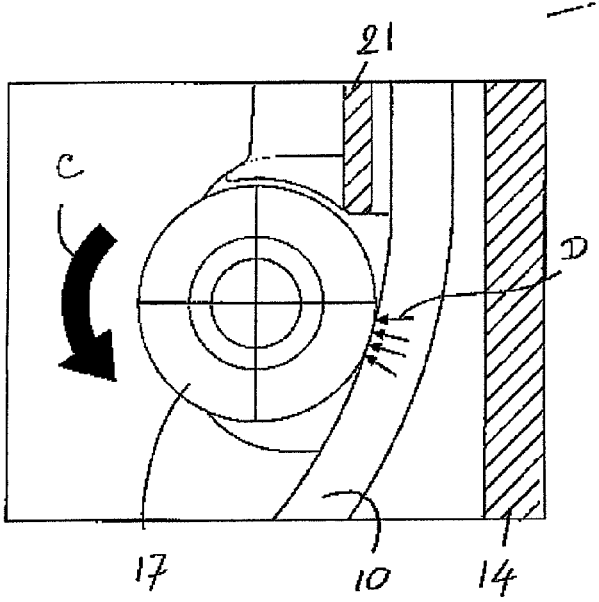
FIG. 14 shows, on a large scale, a detail of FIG. 13.

In FIGS. 13 and 14, the bead 10 of the shutter has been pulled out of its slideway 7. By subjecting the shutter to an upward movement in the direction of the arrow Z, the bead 10 is pulled upward in the direction of the arrow Z and runs over the rollers 17 which, by turning in the direction of the arrow C, push the bead 10 through the aperture 23 into the slideway 7. FIG. 14 shows the forces D applied by the rollers 17 to the bead 10.

Figure 15:
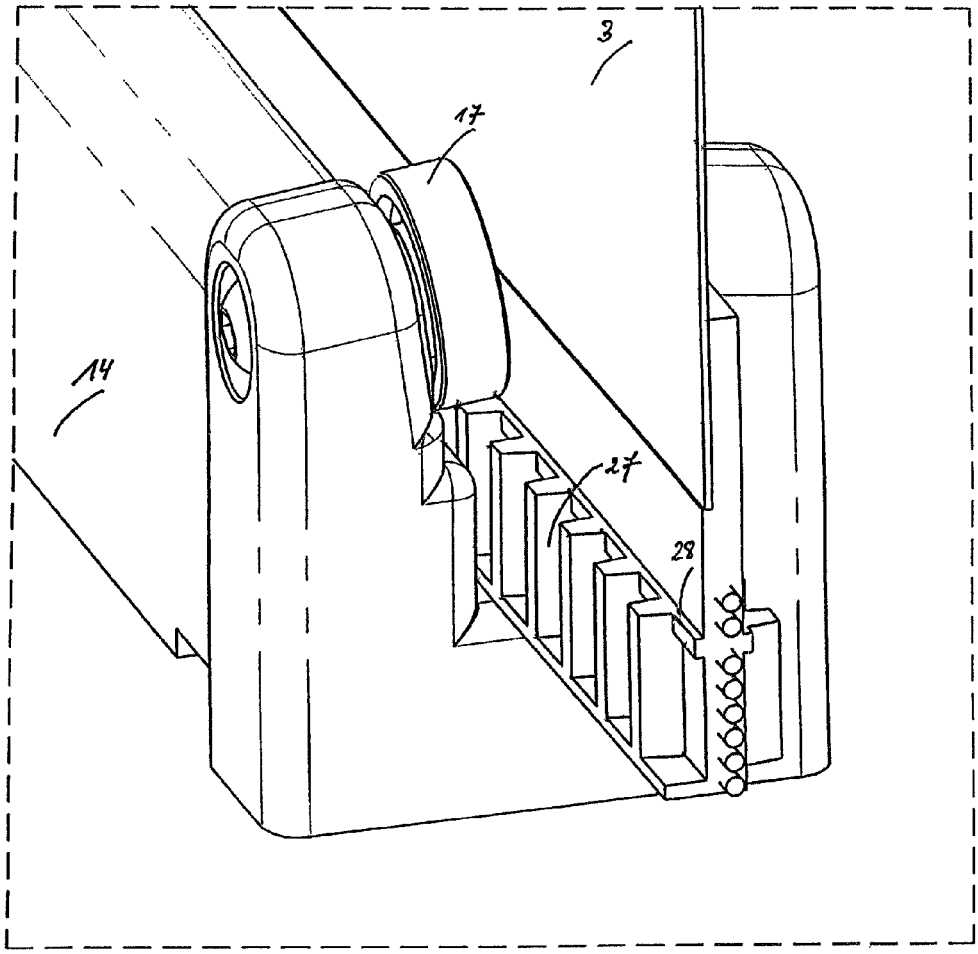
FIG. 15 is a perspective view of the lower part of the reinsertion element according to the invention.

FIG. 15 shows a bead 27 of the shutter 3, said bead 27 having a toothed form on each side of the mid-plane of the shutter 3. Advantageously, the toothed bead 27 is provided with a continuous shoulder 28 offering the rollers 17 a continuous contacting bearing region. To make the drawing clearer, the slideway 7 is not depicted.

Figure 16:
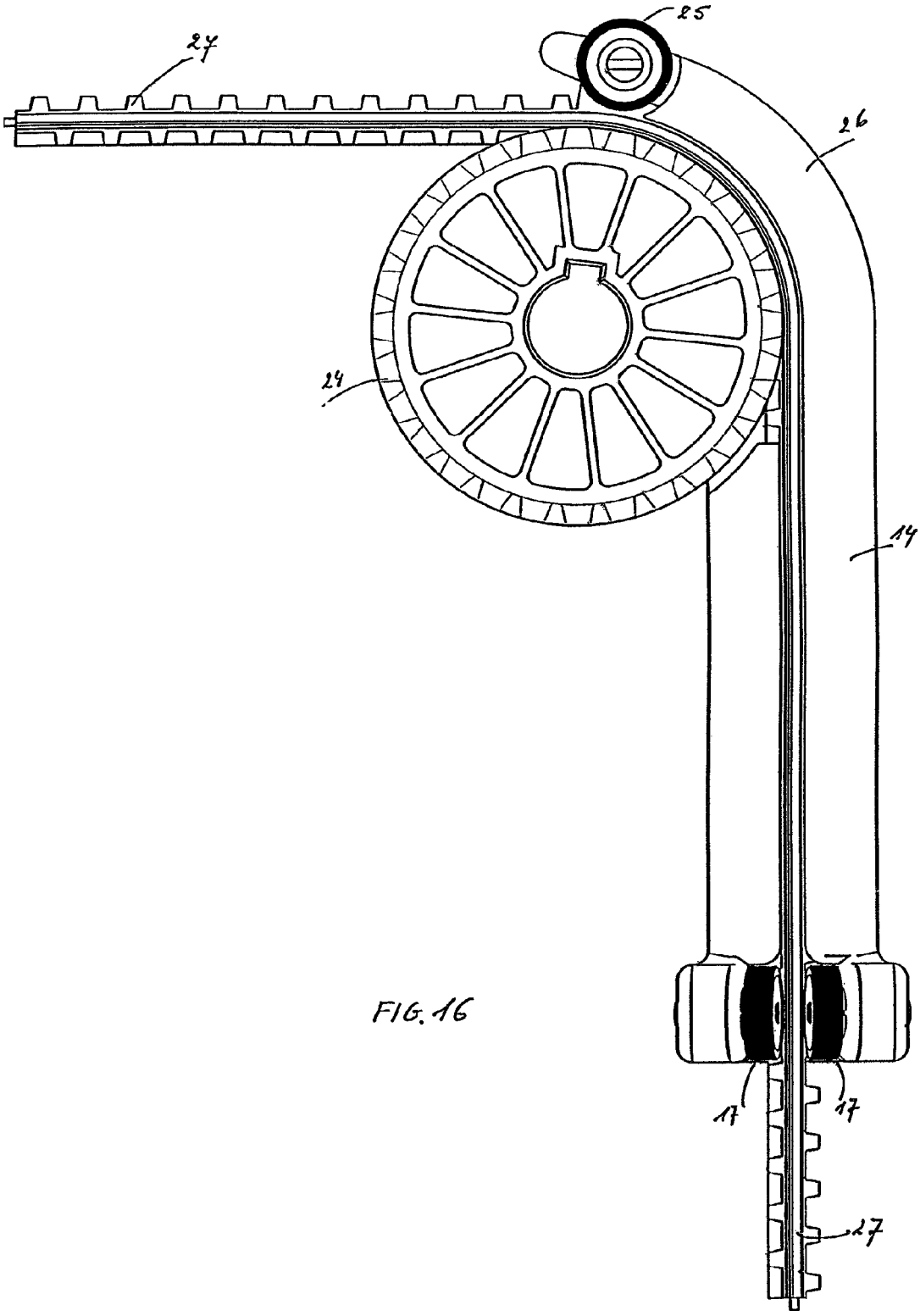
FIG. 16 shows an alternative form of the reinsertion element according to the invention.

In FIG. 16, it may be seen that the reinsertion element according to the invention is incorporated into a shutter device comprising, on each side, a toothed deflecting pulley 24 allowing the shutter 3 to change direction, the deflecting pulleys 24 being mounted to rotate and secured for example by an axle, not depicted. The deflecting pulleys 24 may, as appropriate, drive the shutter 3. The reinsertion element has a curved portion 26 provided with a guide roller 25 which is intended to keep the toothed bead 27 engaged with the return pulley 24 and keep it, whatever the direction of sliding, inside the channel 15 or the slideway 7.

When describing the figures, it has been assumed that the opening 1 is vertical and that the shutter is hung from a drum 4 arranged above the opening. In such an embodiment, the shutter is subjected to an upward movement in order to uncover the opening.

However, the invention also applies to the case where the drum 4 is situated at the bottom of the opening 1. In this modified embodiment of the invention, the drum may, for example, be housed in a gulley situated below floor level. In this embodiment, the shutter is subjected to a downward movement to uncover the opening and to an upward movement to cover it.

In another modified embodiment of the invention, the slideway 7 is horizontal and positioned along the upper horizontal edge of the opening 1, while the slideway 8 is arranged along the lower horizontal edge of the opening. In this embodiment of the invention, the beads 10 and 11 of the shutter 3 are horizontal and the drum 4 is vertical and arranged along one of the vertical edges of the opening 1.

The invention claimed is:

1. A shutter device for closing of an opening, comprising: at least one slideway;

a deformable shutter that can be moved across the opening, in one direction to cover said opening or in the opposite direction to uncover it, said shutter comprising at least one lateral edge fitted with a lateral bead which is slideably mounted in the slideway and which can be extracted therefrom under the action of a defined pulling force directed transversely to the slideway;

a means for reinserting into the slideway the bead that has been extracted therefrom, this means comprising a guide member which is positioned facing the slideway and which is designed so that, while the shutter is being moved in the aforementioned opposite direction, it deflects toward the slideway the bead that has been extracted from this slideway, characterized in that the guide member comprises at least one pair of rollers having fixed axes of rotation which are located symmetrically on each side of the mid-plane of the shutter, in the same plane substantially perpendicular to said mid-plane of the shutter and are directed obliquely with respect to said mid-plane of the shutter so that the rollers converge toward the bottom of the slideway and roll, as the shutter is moved in the aforementioned opposite direction, along the bead which has been extracted from the slideway, pushing it into the slideway.

2. The device according to claim 1, characterized in that the at least one slideway is straight.

3. The device according to claim 1, characterized in that the at least one slideway has a straight part and a part comprising at least one curved branch.

4. The device according to claim 3, characterized in that it further comprises at least one deflecting member, adapted for driving, rotatably mounted facing the curved branch of the at least one slideway and able to engage with the lateral bead of the shutter.

5. The device according to claim 4, characterized in that it additionally comprises at least one guide roller capable of keeping the bead engaged with the at least one deflecting member, adapted for driving.

6. The device according to claim 1, characterized in that the rollers have fixed axes of rotation which are located symmetrically on each side of the mid-plane of the shutter and in the same plane substantially perpendicular to the mid-plane of the shutter.

7. The device according to claim 1, characterized in that the rollers are ribbed.

8. The device according to claim 1, characterized in that, in its zone adjoining the rollers, the slideway is set into an axial channel of a reinforcing frame.

9. The device according to claim 1, characterized in that the shutter comprises a second lateral bead which is slideably mounted in a second slideway from which it can be extracted under the action of a defined pulling force directed transversely to the slideway, and in that a second pair of rollers are arranged respectively on each side of the shutter such that when the shutter is being moved in the aforementioned opposite direction, the rollers of said second pair roll along said second bead which has been extracted from said second slideway, pushing it into this slideway.

10. The device according to claim 1, characterized in that the shutter comprises a flexible tarpaulin.

11. An element for reinserting a lateral bead of a flexible shutter into a slideway from which said bead has been extracted, comprising a frame designed to be mounted on a support of the slideway, the frame comprising, on the one hand, a U-section axial channel into which the slideway can be set, and, on the other hand, at least one pair of rollers which are situated beyond one end of the aforementioned channel and have fixed axes of rotation which are located symmetrically on each side of the mid-plane of the channel of the frame, in the same plane substantially perpendicular to said mid-plane of the channel and directed obliquely with respect to the aforementioned mid-plane of the channel of the frame such that the rollers converge toward the bottom of the channel and, when the slideway is set into the channel of the frame, roll along the bead that has been extracted from the channel section and force it back into the latter when the shutter is moved in a defined direction.

12. The element according to claim 11, characterized in that the frame has a curved portion.

13. The element according to claim 12, characterized in that the curved portion of the frame is provided at one of its ends with a guide roller.

* * * * *